US005926970A

United States Patent [19]

Zonco

[11] Patent Number: 5,926,970

[45] Date of Patent: Jul. 27, 1999

[54] FINISHING MACHINE FOR FABRICS IN ROPE OR OPEN-WIDTH FORM

[75] Inventor: Maurizio Zonco, Coggiola, Italy

[73] Assignee: Zonco Federico & Figlio S.p.A., Pray, Italy

[21] Appl. No.: 09/019,039

[22] Filed: Feb. 5, 1998

[30] Foreign Application Priority Data

Feb. 6, 1997 [IT] Italy ..... MI97A0236

[51] Int. Cl.[6] ..... D06F 58/00

[52] U.S. Cl. ..... 34/115; 34/126; 34/130; 34/211; 68/20; 28/165

[58] Field of Search ..... 34/108, 109, 110, 34/112, 114, 115, 126, 130, 201, 208, 210, 211; 26/52, 74, 76, 86, 90, 98; 28/165; 68/16, 19.2, 20, 58

[56] References Cited

U.S. PATENT DOCUMENTS

| | | | |
|---|---|---|---|
| 2,972,177 | 2/1961 | Bidgood, Jr. | 26/1 |
| 3,906,596 | 9/1975 | Fleissner | 34/115 |
| 4,419,871 | 12/1983 | Zonco et al. | 68/22 R |
| 4,773,133 | 9/1988 | Voisin et al. | 26/18.5 |
| 5,608,955 | 3/1997 | Bozzo | 28/167 |
| 5,678,429 | 10/1997 | Zonco | 68/20 |

FOREIGN PATENT DOCUMENTS

| | | |
|---|---|---|
| 0723045 | 7/1996 | European Pat. Off. . |
| 3201590 | 10/1982 | Germany . |

*Primary Examiner*—Henry Bennet
*Assistant Examiner*—Steve Gravini
*Attorney, Agent, or Firm*—Jacobson, Price, Holman & Stern, PLLC

[57] ABSTRACT

A wet and/or dry finishing machine for fabrics in rope or open-width form comprising a treatment tank in which a transporting means is installed for the fabric, for example in endless-loop form, the transporting means drawing the fabric from the base of the tank and feeding it against a counteracting fuller element, in proximity to at least one base wall portion of the tank there being positioned a duct provided with apertures and through which an air stream is circulated, a portion of the fabric bearing on the top of the duct. This improves drying and shortens the drying time.

9 Claims, 2 Drawing Sheets

FINISHING MACHINE FOR FABRICS IN ROPE OR OPEN-WIDTH FORM

Figure 1:
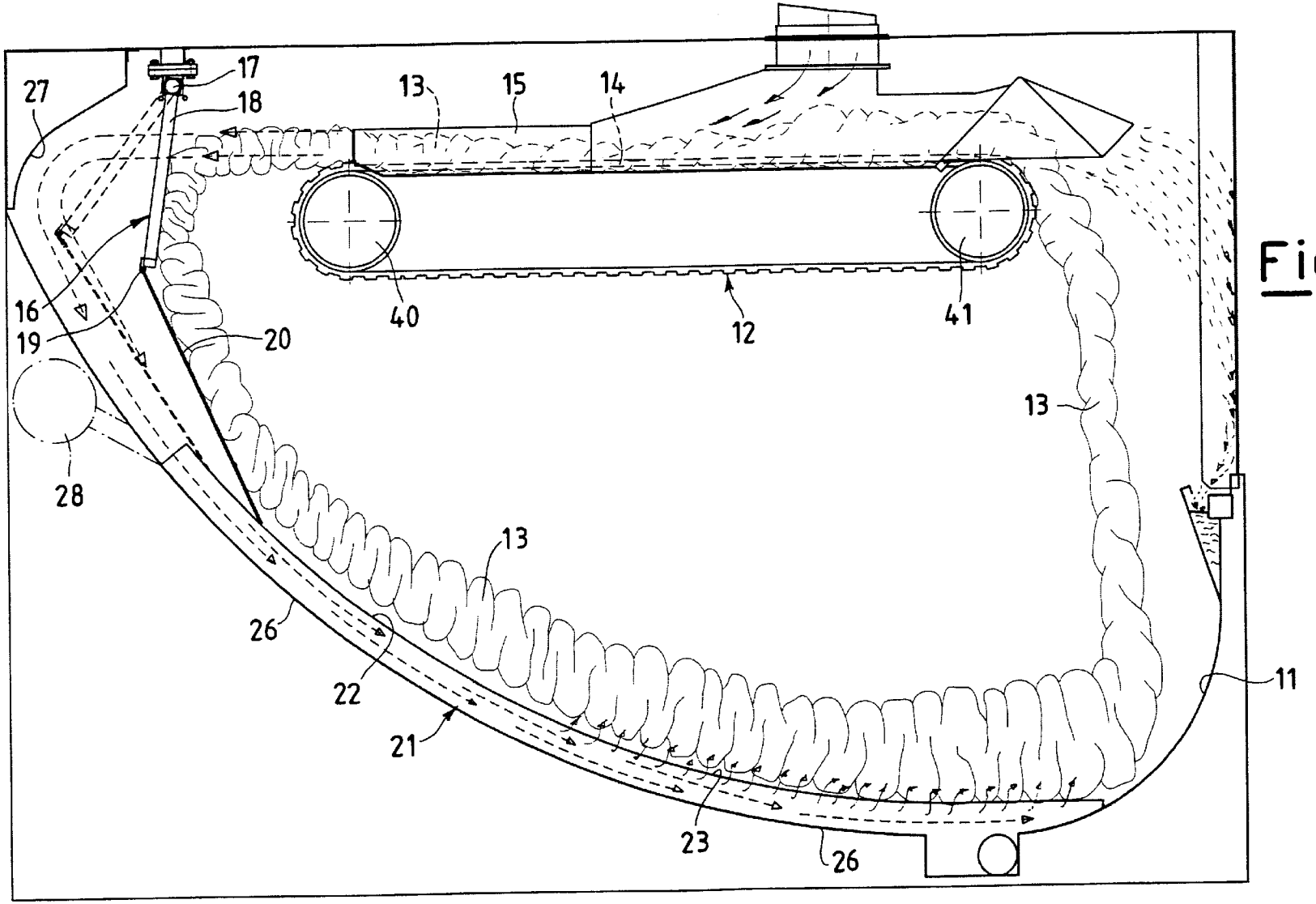

This invention relates to a finishing machine for fabrics in rope or open-width form.

In this specification the term "finishing" is intended to mean an entire series of preferably wet but also dry treatments carried out on fabrics in rope or open-width form, such as scouring, fulling, etc. The term "fabrics" is intended to mean woollen, cotton, silk, synthetic or mixed fabrics of any type and weight (light, heavy or medium weight).

For treating fabrics in rope or open-width form, various machines are currently used comprising a treatment tank within which a transporting means for the fabric is installed. The fabric is in the form of a closed loop and is moved between the base of the tank, the transporting means and a counteracting element, such as a fulling plate located in proximity to the transporting means. In some of these machines, such as that described in European Patent Application EP-A-723 045 of the same applicant, ducts are arranged to feed an air stream onto the transporting means to improve the treatment operation. This air stream prevents the formation of creases in the fabric, enabling a better product to be obtained at a high rate.

With wet treatment, the fabric drying time represents virtually the entire treatment time, which consequent considerable cost. To achieve proper drying, this time is necessarily lengthy. The object of the invention is to achieve in a generic fabric treatment machine both a considerable saving in drying time and an excellent final product.

This object is attained according to the invention by a finishing machine for fabrics in rope or open-width form comprising a treatment tank in which a transporting means for the fabric is installed, said transporting means drawing the fabric from the base of the tank and feeding it against a counteracting fuller element, characterised in that in proximity to at least one base wall portion of said tank there is positioned a duct provided with apertures and through which an air stream is circulated, a portion of said fabric resting on top of said duct.

Advantageously the duct also comprises a further part extending to a side wall portion of said tank.

The air stream circulated through said duct is the air which emerges from a conveying channel located above said transporting means and which grazes the side wall of said tank.

In a preferred embodiment there is also provided a smoothly extending deviator element arranged to direct said air stream leaving said conveying channel towards said side wall of said tank.

To better facilitate air circulation, an external fan introducing further air can be associated with the duct.

The fabric can be in the form of an endless loop.

Consequently, with the machine of this invention a supplementary action can be developed on the fabric by an air stream which produces a considerable improvement in the drying time of the fabric under treatment.

Furthermore at least a partial separation of the bath is achieved, allowing much faster and better scouring and/or rinsing than is obtainable with current machines.

Figure 2:
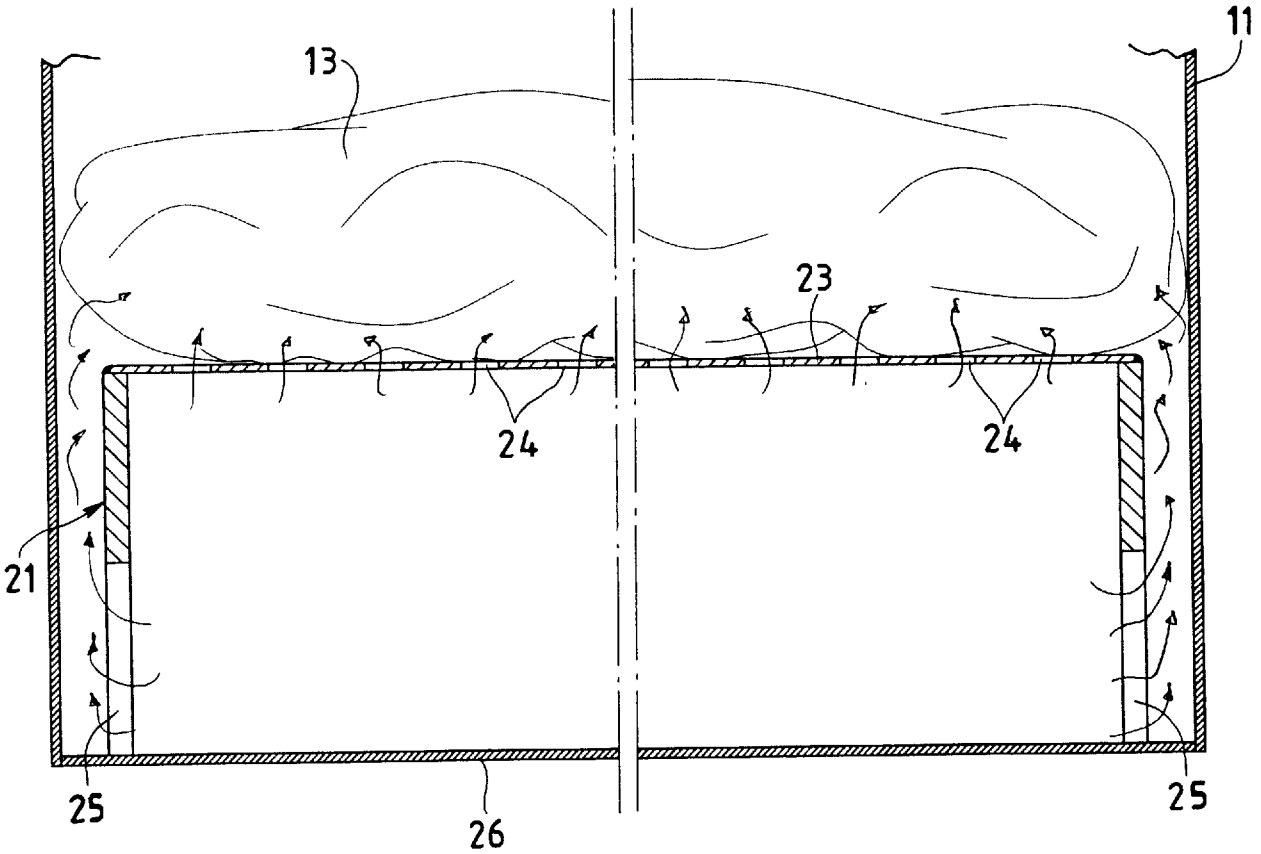

Further characteristics of a machine of the invention will be more apparent from the description of one embodiment of a finishing machine for fabrics in rope or open-width form given hereinafter by way of non-limiting example with reference to the accompanying drawings, on which:

FIG. 1 is a schematic vertical section through a machine of the invention; and FIG. 2 is a cross-sectional detail of part of the machine of FIG. 1.

With reference to FIG. 1, this shows a finishing machine for fabrics in rope or open-width form according to the invention, comprising essentially a treatment tank 11 above which there is located a transporting means, such as a conveyor belt 12 for a fabric in rope form 13 inserted into the machine in endless-loop form or as continuous fabric. The conveyor belt 12 passes about two return rollers 40 and 41, one of which is driven.

The fabric 13 in rope form rests on the upper branch 14 of the conveyor belt 12 and is drawn and raised from the base of the tank 11, to be fed against a counteracting fulling element 16. In addition, for example, to facilitate the advancement of the fabric at high speed, above the upper branch 14 of the conveyor belt 12 there is positioned an air conveying channel 15, for example for pressurized air fed by a fan, not shown.

Said counteracting fulling element indicated overall by 16 is located in the top of the tank 11 in proximity to the end of the upper branch 14, to rotate about an upper pivot 17. The counteracting element 16 consists of an air-permeable element, for example a series of rods 18 (only one of which is shown) rotatable about the pivot 17 and spaced apart to define interspaces.

Alternatively it can be a grid or similar element. To the lower end of the rods 18 there is pivoted, at 19, a fairly flexible flat element 20, for example formed of teflon or stainless steel. According to the invention, in proximity to a side and/or base wall 26 of the tank 11 there is provided a duct 21 into which, as will be apparent, a further air stream is fed. In the illustrated example, the duct 21 comprises a completely closed first part 22, and a second part 23 provided with apertures 24 in its top and further apertures 25 in its sides.

Within the machine, beyond the counteracting fulling element 16 on the opposite side thereof to the conveyor belt 12, there is provided a smoothly extending deviator portion or deviator element 27, for example of rounded form, arranged to direct an air stream leaving the conveying channel 15 towards the side or base wall 26 of the tank 11.

Air deviation is also facilitated by the presence of the flat element 20 which inter alia advantageously serves to direct the fabric 13 onto the duct 21.

In an alternative embodiment shown by dashed and dotted lines in FIG. 1, in correspondence with said side or base wall 26 there can be provided an external fan 28 which feeds air into the duct 21, to improve and/or achieve air circulation through it.

It will be noted that according to the invention, the arrangement of the duct 21 advantageously results in the formation of a double-base chamber above which the fabric 13 lies. The presence of the apertures 24 and 25 produces a flow of air from the bottom upwards which strikes the fabric and facilitates its drying.

The air flow is preferably a hot air flow determined directly by the air arriving from the conveying channel 15, and passing through the fulling element 16 to graze the side and base wall 26, as shown by the arrows. Alternatively or additionally, the hot air flow can be simply provided directly by the external fan 28. Hence according to the invention, rapid drying of the treated fabric can be achieved, at reduced cost.

Advantageously, as an air flow can be provided to strike the fabric which collides with the counteracting fulling element 16, a further improvement in water separation is achieved.

This air flow also further facilitates separation of any foreign bodies present on the fabric.

Arranging the duct in proximity to the base of the tank 11 also results in separation of the bath, allowing much faster and better scouring and/or rinsing.

The Italian priority application No. MI97A 000236 is herein incorporated by reference.

I claim:

1. A finishing machine for fabrics in rope or open-width form comprising a treatment tank in which a transporting means for the fabric is installed, said transporting means drawing the fabric from the base of the tank and feeding it against a counteracting fuller element, characterised in that in proximity to at least one base wall portion of said tank there is positioned a duct provided with apertures and through which an air stream is circulated, a portion of said fabric bearing on the top of said duct.

2. A machine as claimed in claim 1, characterised in that said duct also comprises a further part extending to a side wall portion of said tank.

3. A machine as claimed in claim 1, characterised in that said air stream circulated through said duct is the air which emerges from a conveying channel located above said transporting means and which grazes the side wall of said tank.

4. A machine as claimed in claim 3, characterised by providing within said tank a smoothly extending deviator portion arranged to direct said air stream leaving said conveying channel towards said side wall of said tank.

5. A machine as claimed in claim 1, characterised in that an external fan for introducing air is associated with said duct.

6. A machine as claimed in claim 1, characterised in that said counteracting fulling element consists of an air-permeable element rotatable about a pivot.

7. A machine as claimed in claim 6, characterised in that said air-permeable element consists of a series of rods rotatable about a pivot and spaced apart to define inter-spaces.

8. A machine as claimed in claim 1, characterised in that said counteracting fulling element extends downwards into an element which at least partly overlies said duct.

9. A machine as claimed in claim 1, characterised in that said fabric is in the form of an endless loop.

* * * * *